US005382995A

United States Patent [19]

Glover et al.

[11] Patent Number: 5,382,995

[45] Date of Patent: Jan. 17, 1995

[54] PHOTOGRAPHIC PROCESSING APPARATUS

[75] Inventors: Edward C. T. S. Glover, London; Peter D. Marsden, North Harrow, both of United Kingdom

[73] Assignee: Eastman Kodak Company, Rochester, N.Y.

[21] Appl. No.: 30,030

[22] PCT Filed: Jun. 22, 1992

[86] PCT No.: PCT/EP92/01398

§ 371 Date: Apr. 26, 1993

§ 102(e) Date: Apr. 26, 1993

[87] PCT Pub. No.: WO93/00612

PCT Pub. Date: Jan. 2, 1993

[30] Foreign Application Priority Data

Jun. 29, 1991 [GB] United Kingdom ..... 9114090

[51] Int. Cl.[6] ..... G03D 13/02

[52] U.S. Cl. ..... 354/331; 354/339

[58] Field of Search ..... 354/319–324, 354/331, 336, 339

[56] References Cited

U.S. PATENT DOCUMENTS

| | | | |
|---|---|---|---|
| 2,428,681 | 10/1947 | Pratt et al. | 95/94 |
| 3,601,029 | 8/1971 | Needleman | 95/89 |
| 3,635,144 | 1/1972 | Beck | 95/89 |
| 3,774,521 | 11/1973 | Beck | 95/87 |
| 3,791,345 | 2/1974 | McCutcheon | 118/637 |
| 3,922,702 | 11/1975 | Gaskell | 354/321 |
| 4,003,070 | 1/1977 | Merz et al. | 354/322 |
| 4,512,645 | 4/1985 | Engelhardt et al. | 354/324 |
| 4,512,645 | 4/1985 | Engelhardt et al. | 354/324 |
| 4,688,917 | 8/1987 | Muller et al. | 354/320 |
| 4,736,222 | 4/1988 | Stromberg | 354/324 |
| 4,845,019 | 7/1989 | Vaughan, IV | 430/422 |
| 4,945,934 | 8/1990 | Vaughan, IV | 134/64 |
| 4,954,425 | 9/1990 | Iwano | 430/373 |

FOREIGN PATENT DOCUMENTS

| | | | |
|---|---|---|---|
| 0105833 | 10/1982 | European Pat. Off. | G03D 3/02 |
| 1268126 | 3/1972 | United Kingdom | G03C 5/00 |
| 1399481 | 7/1975 | United Kingdom | G03C 7/30 |
| 1403418 | 8/1975 | United Kingdom | G03C 1/02 |
| 1560572 | 2/1980 | United Kingdom | G03C 5/42 |
| 89/0728 | 5/1989 | WIPO | B08B 1/02 |
| 91/12567 | 8/1991 | WIPO | G03D 3/06 |

*Primary Examiner*—D. Rutledge
*Attorney, Agent, or Firm*—Frank Pincelli

[57] ABSTRACT

In photographic processing apparatus in which continuous processing is carried out in a tank having a low volume, it is difficult to obtain sufficient agitation of the processing solution. This problem arises because processing solution adheres to the emulsion surface of the material being processed access of fresh processing solution to the emulsion surface is restricted in the narrow confines of the tank. Described herein is an arrangement in which the agitation of the solution is improved. The arrangement includes an element (16) which is positioned over a feed slot (18) through which processing solution enters the tank (10). The element (16) serves to keep the emulsion surface of the material being processed away from the tank wall and allows access of processing solution to the emulsion surface.

9 Claims, 2 Drawing Sheets

PHOTOGRAPHIC PROCESSING APPARATUS

FIELD OF THE INVENTION

This invention relates to photographic processing apparatus and is more particularly concerned with such apparatus in which chemically unstable solutions are utilised.

BACKGROUND OF THE INVENTION

Conventional colour photographic silver halide materials are processed by a process which includes a colour development step. In this step silver halide is reduced to metallic silver in the light-exposed areas and the oxidised colour developer formed in This reaction then couples with a colour coupler and forms image dye. The amount of dye produced is proportional to the amount of silver halide reduced to metallic silver.

Redox amplification processes have been described, for example in British Patent Specifications GB-A-1 268 126, GB-A-1 399 481, GB-A-1 403 418 and GB-A-1 560 572. In such processes colour materials are developed to produce a silver image (which may contain only small amounts of silver) and then treated with a redox amplifying solution to form a dye image. The redox amplifying solution contains a reducing agent, for example a colour developing agent, and an oxidising agent which is more powerful than silver halide and which will oxidise the colour developing agent in the presence of the silver image which acts as a catalyst. Oxidised colour developer reacts with a colour coupler (usually contained in the photographic material) to form image dye. The amount of dye formed depends on the time of treatment or the availability of colour coupler rather than the amount of silver in the image as is the case in conventional colour development processes. Examples of suitable oxidising agents include peroxy compounds including hydrogen peroxide, cobalt (III) complexes including cobalt hexammine complexes, and periodates. Mixtures of such compounds can also be used.

Since the amplifying solution contains both an oxidising agent and a reducing agent it is inherently unstable. That is to say unlike a conventional colour developer solution, amplifier solutions will deteriorate in a relatively short time even if left in a sealed container. The best reproducibility for such a process has been obtained by using a "one shot" system, where the oxidant is added to the developer and the solution mixed and used immediately (or after a short built in delay) and then discarded. This leads to the maximum solution usage possible with maximum effluent and maximum chemical costs. As a result the whole system is unattractive especially for a minilab environment where minimum effluent is required. It is believed that it is these shortcomings that have inhibited commercial use of this process.

Japanese Specification 64/44938 appears to describe such a system in which a silver chloride colour material is processed in a low volume of a single-bath amplifier solution. The processes described therein however fall short of what is required in the fully commercial environment for exactly the reasons given above.

WO-A-91/12567 (corresponding to British Patent Application No. 9003282.2) describes a method and apparatus for photographic processing in which a minimum amount of processing solution can be used in a processing tank which is thin and has a low volume. In order to overcome the inherent deterioration problem due to the instability of the processing solutions used, the method and apparatus described result in the need for high recirculation and/or replenishment rates. However, problems associated with non-uniform processing of the photographic material may be encountered due to local differences in the concentration of the processing solution.

U.S. Pat. No. 4,512,645 discloses a tank arrangement for the processing of photographic material in which improved material transportation and chemistry circulation are provided. This is achieved by having a tank with an integrally formed round bottom with a hollow contoured tank divider. The tank divider has an inlet port through which processing solution is added. A plurality of apertures are formed along the length of the divider through which processing solution is applied to the emulsion surface of the material being processed. Processing solution is discharged from the tank via an overflow port. In this arrangement, contact between the emulsion surface of the material and the walls of the tank is reduced due to the concave shape of the tank divider. This concave shape also allows processing solution to be circulated within the tank prior to its discharge via the overflow port.

However, the tank arrangement described in U.S. Pat. No. 4,512,645 requires a relatively large amount of processing solution to be present in the tank, and there is no recirculation of the solution. Such an arrangement, however, is unsuitable for use with unstable processing solutions as discussed above.

One problem associated with continuous processing in a tank having a low volume (typically 100 ml for a tank having a thickness of 1.5 mm, a width of 125 mm and a path length of 550 mm), is to obtain sufficient agitation of the processing solution. This problem arises because processing solution adheres to the emulsion surface of the material being processed and it is not removed (wiped off), and access of fresh processing solution to the emulsion surface is restricted in the narrow confines of the tank.

It is therefore an object of the present invention to improve access of processing solution to the emulsion surface of the material being processed, and as a result, provide more uniform processing of the photographic material.

SUMMARY OF THE INVENTION

According to one aspect of the present invention, there is provided photographic processing apparatus for processing photographic material, the apparatus comprising:

a processing tank;

at least one feed aperture through which processing solution is added to the processing tank; and at least one exit aperture through which solution is extracted from the tank for recirculation and replenishment;

characterized in that spacing means are provided along a wall of the tank over each of the feed apertures to keep the material away from the tank wall.

By this arrangement, recirculation of the processing solution in the tank aids agitation and prevents the formation of drag lines and uneven processing by mixing replenisher and the tank solution efficiently and by forcing the solution against the emulsion surface.

DESCRIPTION OF THE DRAWINGS

For a better understanding of the present invention, reference will now be made, by way of example only, to the accompanying drawings in which.

DETAILED DESCRIPTION OF THE INVENTION

Figure 1:
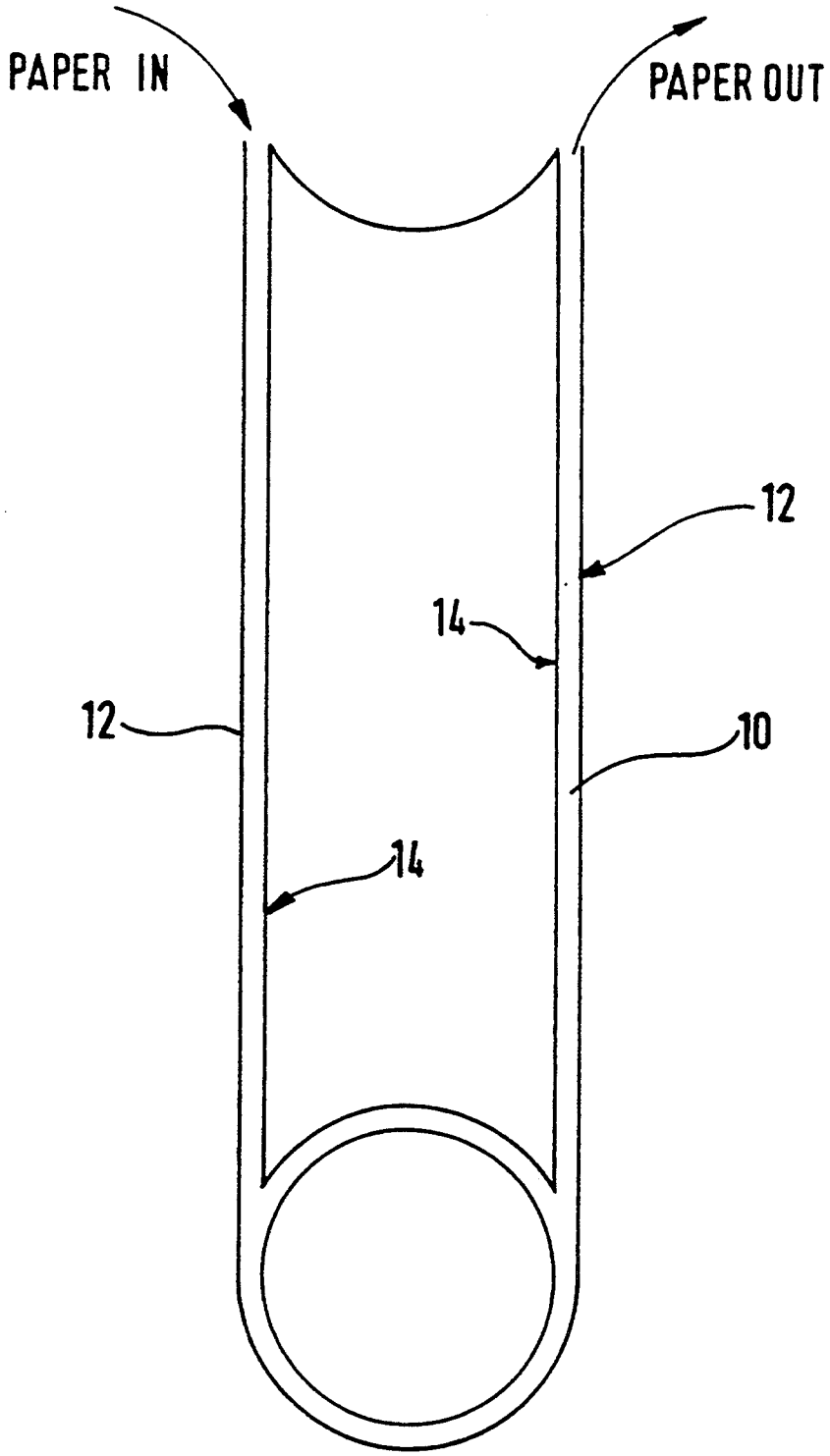
FIG. 1 is a schematic sectioned view through a low volume processing tank.

FIG. 1 shows a low volume processing tank 10. The tank 10 is defined by an outer wall 12 and an inner wall 14. The spacing between outer wall 12 and inner wall 14 is 1.5 mm.

Figure 2:
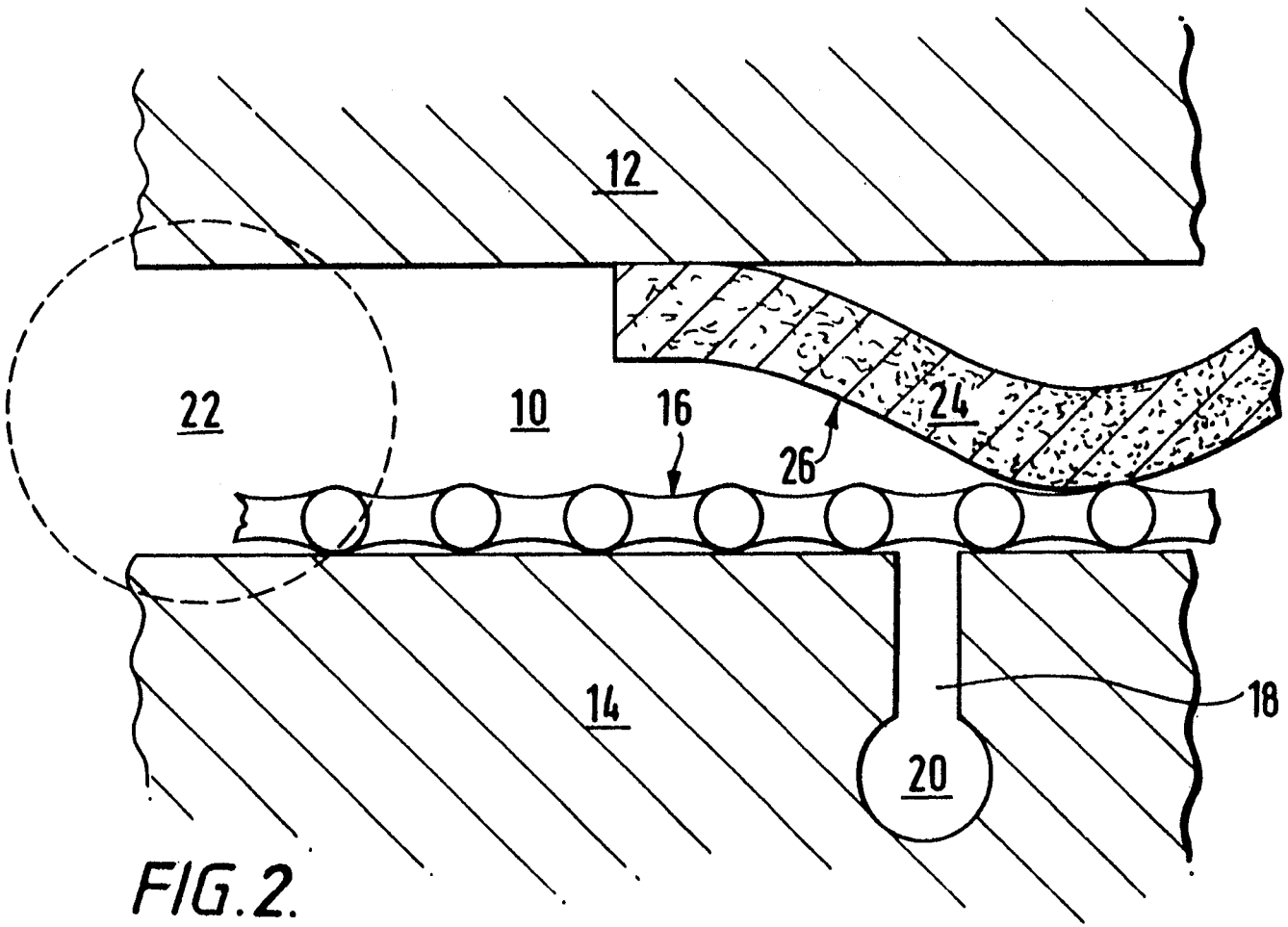
FIG. 2 is an enlarged, fragmentary sectioned view through the tank shown in FIG. 1 which shows an element according to the present invention in detail.

FIG. 2 illustrates a portion of the tank 10 and in particular, an element 16 according to the present invention. A number of elements 16 can be fitted along the entire path length of the tank 10.

Element 16 comprises a piece of plastic mesh which is approximately 0.350 mm thick and having a filament pitch of 1.5 mm. The element 16 is positioned to cover a feed aperture 18 formed in inner wall 14, and is glued in place using a suitable adhesive. In the particular embodiment illustrated, the feed aperture comprises a slot 18 which extends across the entire width of the tank 10. Processing solution is supplied from a feed cavity 20 to the feed slot 18 and then enters the tank 10.

Alternatively, the feed aperture 18 may comprise a series of feed holes which extends across the width of the tank 10. In this case, the element 16 needs to be continuous at least in the region of the feed holes so that the processing solution entering the tank 10 through the holes is properly circulated. Away from the holes, the element 16 can be a mesh as described above.

A piece of photographic paper 24 is shown with its emulsion surface 26 facing inner wall 14. Element 16 prevents the surface 26 contacting wall 14. Additionally, the force of the processing solution coming out of the feed slot 18 assists in preventing the surface 26 from contacting wall 14.

At least one side exit port 22 is provided to remove processing solution from the tank 10. Exit ports 22 are connected to the feed apertures 18 via feed cavity 20 and allow processing solution to be recirculated using a pump arrangement (not shown). This has the effect of flushing the emulsion surface 26 of the paper 24 with processing solution which has been both recirculated and replenished. The flushing of the emulsion surface 26 aids agitation and leads to uniform processing.

Agitation members (not shown) may also be present in the tank 10. These members improve agitation between the feed apertures 18 and side exit ports 22 through which processing solution is taken out of the tank 10 and returned to it via the feed aperture 18. In practice, a number of feed slots 18 are positioned throughout the path length but only one or two exit ports 22 are required.

Processing solution in tank 10 is recirculated at a high rate typically 800 $mlmin^{-1}$. This corresponds to circulating one tank volume every 8 to 15s. Agitation is improved if the direction of recirculating flow is opposite to that of the direction of paper transport.

During the recirculation, the processing solution is replenished, and the combined solution is reheated before being pumped back through feed slot 18. Low volume pipes and pumps are used to keep the total volume to an acceptable minimum level.

In the case of RX chemistry, the recirculation system allows for an instant start up filled with the developer/amplifier solution, and when required, starter solution and hydrogen peroxide can be pumped into the recirculation loop.

The number of feed slots 18 may be varied, with between two and five slots being provided for a path length of approximately 550 mm. The recirculation rate may also be varied from approximately 300 $mlmin^{-1}$ to 800 $mlmin^{-1}$ for an approximate total system volume (the total volume of solution required for the tank and its associated low volume pipes and pumps) of between 150 ml and 270 ml respectively. The normal rate of addition of replenisher under these conditions is about 40 $mlmin^{-1}$.

Higher rates of recirculation could be used, e.g. 2 to $4lmin^{-1}$. However, at these higher rates the pressure in the system would be increased because it is still necessary to minimise the total volume of the system (i.e. tank plus pipes plus pumps).

The feed slot 18 shown in FIG. 2 is 0.40 mm wide and 5 to 10 mm deep to connect with the feed cavity 20. The feed cavity 20 has a diameter of approximately 2.5 mm.

The width of the feed slot 18 may be important—a wider slot being able to deliver more solution to the emulsion surface at a given pressure. However, the uniformity of solution supply across the length of the slot also needs to be considered.

The size of the feed cavity 20 may also be important. A larger sized cavity may be more advantageous in that it would give a more uniform supply of solution to the emulsion surface.

The element 16 shown in FIG. 2 was tested in a U-shaped tank with the emulsion surface facing the inside of the bend (that is, away from outer wall 12) as it travelled through the tank 10. However, the emulsion surface may be required to face the other way in other tank arrangements. In some other tank arrangements, it may be necessary to move the feed cavities and slots to the outer wall 12.

Alternatively, element 16 can be removed provided the surface of wall 14 is textured to prevent the emulsion surface adhering to it.

We claim:

1. Photographic processing apparatus for processing photographic material (24, 26), the apparatus comprising:

a processing tank (10, 12, 14);

at least one feed aperture (18) through which processing solution is added to the processing tank (10, 12, 14); and at least one exit aperture (22) through which solution is extracted from the tank (10, 12, 14) for recirculation and replenishment;

characterized in that spacing means (16) are provided along a wall (14) of the tank (10, 12, 14) over each of the feed apertures (18) to keep the material (24, 26) away from the tank wall (14).

2. Apparatus according to claim 1, wherein the spacing means (16) comprises a plastic mesh element which is adhered to the tank wall (14) over said at least one feed aperture (18).

3. Apparatus according to claim 2, wherein the mesh element has a pitch of 1.5 mm and is 0.350 mm thick.

4. Apparatus according to claim 1, wherein the at least one feed aperture (18) comprises a series of feed holes which extend across the width of the tank (10, 12, 14).

5. Apparatus according to claim 1, wherein the at least one feed aperture (18) comprises an elongate slot extending across the width of the tank (10, 12, 14).

6. Apparatus according to claim 1, wherein the at least one feed aperture (18) is connected to a feed cavity (20).

7. Apparatus according to claim 6, wherein the feed cavity (20) is connected to the at least one exit aperture (22) through a recirculation/replenishment system.

8. Apparatus according to claim 1, wherein the processing tank (10, 12, 14) is generally U-shaped and has a low volume.

9. Apparatus according to claim 1, wherein the processing tank (10, 12, 14) has a thickness of approximately 1.5 mm.

* * * * *